US008656898B2

(12) United States Patent
Sackmann et al.

(10) Patent No.: US 8,656,898 B2
(45) Date of Patent: Feb. 25, 2014

(54) METHOD FOR CONTROLLING A GLOW PLUG

(75) Inventors: Martin Sackmann, Benningen (DE); Bernd Last, Reutlingen (DE); Marc Rottner, Illingen (DE); Hans Houben, Wurselen (DE); Olaf Toedter, Walzbachtal (DE)

(73) Assignee: Borgwarner Beru Systems GmbH, Ludwigsburg (DE)

( * ) Notice: Subject to any disclaimer, the term of this patent is extended or adjusted under 35 U.S.C. 154(b) by 351 days.

(21) Appl. No.: 13/043,806

(22) Filed: Mar. 9, 2011

(65) Prior Publication Data

US 2011/0220073 A1 Sep. 15, 2011

(30) Foreign Application Priority Data

Mar. 11, 2010 (DE) ..... 10 2010 011 044

(51) Int. Cl.
*F02P 19/02* (2006.01)

(52) U.S. Cl.
USPC ..... 123/623; 123/612

(58) Field of Classification Search
USPC ..... 123/608, 612, 628, 594, 143 R, 145 R, 123/169 R, 146.5 C, 146.5 R; 219/260, 262, 219/264, 270
See application file for complete search history.

(56) References Cited

U.S. PATENT DOCUMENTS

| | | | | |
|---|---|---|---|---|
| 4,787,349 | A | 11/1988 | Hilger | |
| 7,319,208 | B2 * | 1/2008 | Gotoh et al. | 219/270 |
| 7,905,209 | B2 * | 3/2011 | Goto et al. | 123/143 R |
| 8,272,256 | B2 * | 9/2012 | Mori et al. | 73/114.18 |
| 2004/0182144 | A1 * | 9/2004 | Okazaki et al. | 73/118.1 |
| 2005/0252297 | A1 | 11/2005 | Heinzelmann et al. | |
| 2006/0032472 | A1 * | 2/2006 | Yamada et al. | 123/145 A |
| 2007/0240661 | A1 * | 10/2007 | Ludwig et al. | 123/145 R |
| 2008/0296281 | A1 * | 12/2008 | Glock et al. | 219/260 |
| 2009/0012695 | A1 | 1/2009 | Kernwein et al. | |
| 2010/0212621 | A1 * | 8/2010 | Ramond et al. | 123/145 R |
| 2010/0236512 | A1 * | 9/2010 | Volland et al. | 123/145 R |

FOREIGN PATENT DOCUMENTS

| | | | |
|---|---|---|---|
| DE | 3631473 | A1 | 3/1988 |
| DE | 3737745 | A1 | 5/1989 |
| DE | 3738055 | A1 | 5/1989 |
| DE | 19828595 | A1 | 12/1999 |
| DE | 102004024341 | B3 | 12/2005 |
| DE | 102006060632 | A1 | 6/2008 |
| DE | 102007031613 | A1 | 1/2009 |

* cited by examiner

*Primary Examiner* — John Kwon
*Assistant Examiner* — Johnny Hoang
(74) *Attorney, Agent, or Firm* — D. Peter Hochberg; Sean F. Mellino; Richard A. Wolf

(57) ABSTRACT

The invention relates to a method for controlling a glow plug to a target value of the surface temperature while the engine is running. An effective voltage is generated by pulse width modulation of a vehicle electrical system voltage. This effective voltage is applied to the glow plug. The electric resistance of the glow plug is measured and compared to a resistance value expected for the target value of the surface temperature. The effective voltage is varied as a function of the deviation of the measured value of the electric resistance from the expected value of the electric resistance. A pressure sensor of the glow plug is used to measure the combustion chamber pressure. The resistance value expected for the target value of the surface temperature is determined as a function of the combustion chamber pressure.

10 Claims, 1 Drawing Sheet

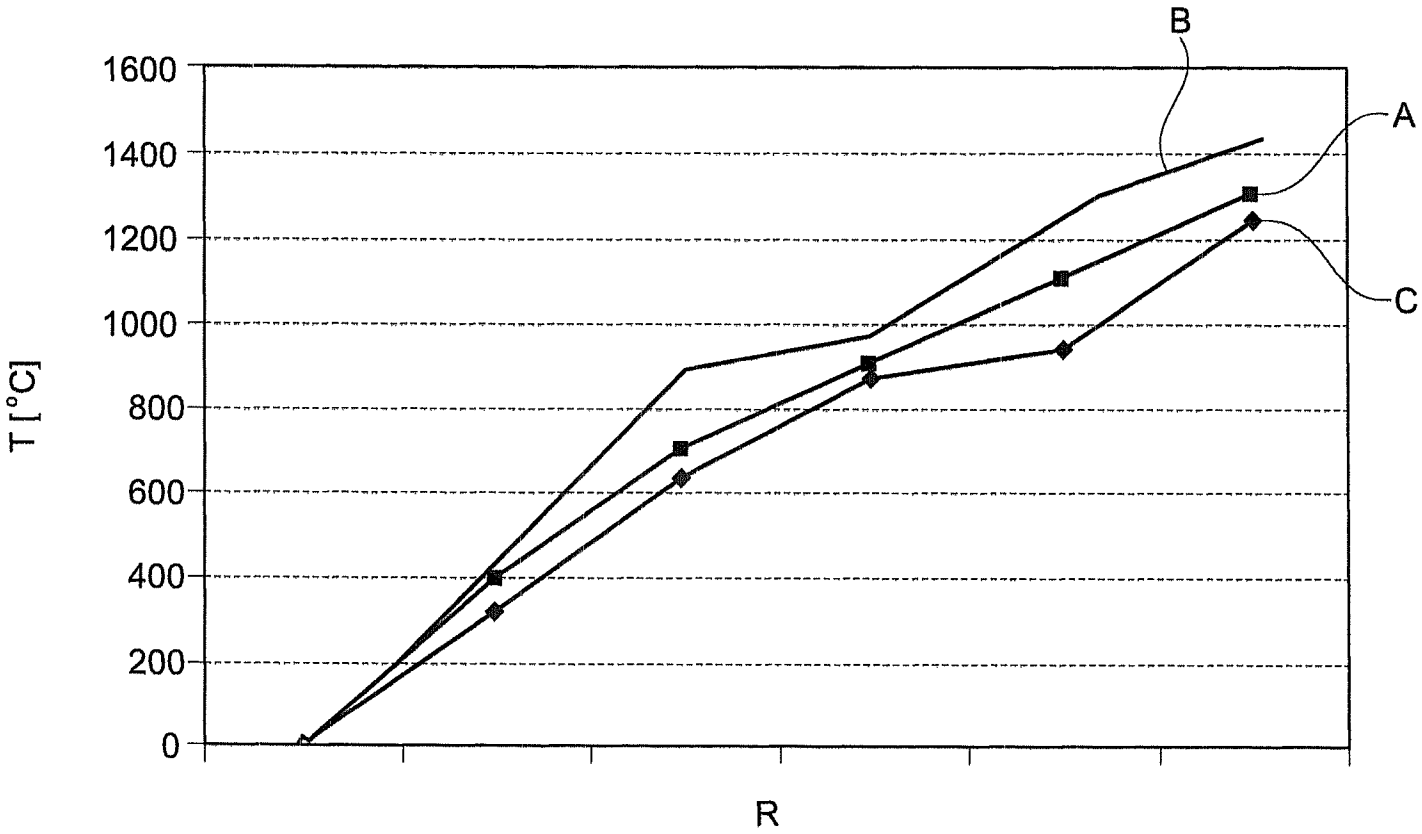
A
B
C
1600
1400
1200
1000
800
600
400
200
0
T [°C]
R

METHOD FOR CONTROLLING A GLOW PLUG

CROSS-REFERENCE TO RELATED APPLICATION

This application claims foreign priority based on German Patent Application Serial No. 10 2010 011 044.2, filed on Mar. 11, 2010, the content of which is incorporated herein by reference in its entirety.

BACKGROUND OF THE INVENTION

1. Field of the Invention

The invention relates to a method having the characteristics provided in the preamble of claim 1.

2. Description of the Prior Art

With modern control devices, glow plugs in diesel engines serve not only as a cold starting aid, but are also used while driving to support and optimize the combustion behavior. When operating a glow plug, special attention must be paid to ensure adherence to a target temperature required for the optimal combustion behavior of the diesel engine. Too low a plug temperature results in less than optimal combustion and increased emission of harmful substances, while exceeding the target temperature puts unnecessary stress on the glow plug and shortens the service life thereof.

The temperature dependence of the electric resistance can be used to control glow plugs to a target temperature. In such control methods, the electric resistance of the glow plug is measured and compared to a resistance value expected for the target value of the temperature. An effective voltage that is generated by pulse width modulation of a vehicle electrical system voltage and applied to the glow plug is varied as a function of the deviation of the measured value of the electric resistance from the expected value of the electric resistance.

SUMMARY OF THE PRESENT INVENTION

It is the object of the invention to show a way of how a glow plug can be better controlled to a target value of the surface temperature when the engine is running.

This object is achieved by a method according to the presently claimed invention.

According to the invention, the combustion chamber pressure is measured using a pressure sensor of the glow plug and the resistance value expected for the target value of the surface temperature is determined as a function of the combustion chamber pressure. In this way, significantly more precise temperature control is possible. The electric resistance of a glow plug substantially depends on the temperature of the heating element, and therefore on the internal temperature of the glow plug. For the combustion behavior of an engine, however, the surface temperature of a glow plug is decisive, which may deviate considerably from the internal temperature of the glow plug. A heating or cooling effect of combustion gases on the surface can be taken into account at least approximately in the control of a glow plug by measuring the combustion chamber pressure and using it to correct the resistance value expected for the target value of the surface temperature.

In order to carry out a method according to the invention, for example, a characteristic curve can be used, which indicates the resistance value expected for a given target value of the surface temperature for a reference pressure. If the measured combustion chamber pressure deviates from the reference pressure, this characteristic curve can be shifted up or down so as to describe the relationship between the surface temperature and electric resistance at a combustion chamber pressure that deviates from the reference pressure. In the simplest case, the expected resistance value can be determined starting from a resistance value for a reference pressure by adding a correction term, which is proportional to the deviation of the measured combustion chamber pressure from the reference pressure, to the resistance value for the reference pressure.

According to an advantageous refinement of the invention, the crankshaft angle is captured during the measurement of the combustion chamber pressure and the electric resistance, then the expected resistance value for a defined crankshaft angle is determined, and a comparison is carried out between the measured resistance and the expected resistance between values that were determined for the same crankshaft angle. It has been found that the crankshaft angle can noticeably influence the surface temperature of a glow plug. By taking the crankshaft angle into consideration in the control of the glow plug, the control quality can be improved.

In the simplest case, the combustion chamber pressure and the electric resistance are measured during a working cycle of the engine only once for a defined crankshaft angle, for example 0°. This suffices to establish the expected resistance value for this crankshaft angle. For this purpose, the glow plug control unit can receive a signal from an engine controller or a crankshaft angle sensor every time the crankshaft angle has the specified value.

However, the electric resistance and the combustion chamber pressure are preferably measured multiple times during a working cycle of the engine, ideally continuously or quasi continuously. If during a working cycle a plurality of measurements, for example more than 10, preferably more than 20, and in particular more than 50, are performed, the curve of the measured resistance and/or the curve of the combustion chamber pressure can be used to determine the respective crankshaft angle. Advantageously, no information about an interface must be provided to a glow plug control unit for this purpose. In order to carry out the method, the electric resistance and the combustion chamber pressure can be evaluated for a specified crankshaft angle. However, during a working cycle preferably values of the expected electric resistance are determined for a plurality of crankshaft angles and compared to those resistance values measured for the respective crankshaft angle. Advantageously, in this way the influence of measurement errors on changes of the effective voltage can be reduced.

Instead of basing the method according to the invention on values for a defined crankshaft angle, it is also possible to use a mean combustion chamber pressure to correct the target resistance, for example.

According to a further advantageous refinement of the invention, the resistance value expected for the target value of the surface temperature is also determined as a function of the rotational speed and/or as a function of the engine load. In this way, the precision of the control process can be further improved, because the surface temperature of a glow plug can also be influenced by the rotational speed and the engine load. The rotational speed of the engine can advantageously be determined by evaluating the curve of the combustion chamber pressure and/or the curve of the electric resistance of the glow plug.

For the method according to the invention, it is possible to use glow plugs having integrated pressure sensors, as they are known from US 2005/0252297 A1, for example. A glow plug control unit can use the pressure information measured with such a glow plug to adapt the resistance value expected for a target value of the surface temperature. Advantageously, pressure information can also be provided to an engine controller, which can then evaluate this information and use it to control the combustion process, for example the injection quantity. The temperature of the glow plug determined from the measured resistance can be used for temperature drift compensation.

BRIEF DESCRIPTION OF THE DRAWINGS

Further details and advantages of the invention will be described hereinafter in an embodiment with reference to the attached drawing.

FIG. 1 shows a schematic illustration of the relationship between the surface temperature of a glow plug and the electric resistance thereof for different values of the combustion chamber pressure.

DETAILED DESCRIPTION OF THE PRESENT INVENTION

In a method according to the invention for controlling a glow plug to a target value of the surface temperature while the engine is running, an effective voltage is generated by pulse width modulation of a vehicle electrical system voltage and this effective voltage is applied to the glow plug, the electric resistance of the glow plug is measured, compared to a resistance value expected for the pressure dependent target value of the surface temperature, and the effective voltage is varied as a function of the deviation of the measured value of the electric resistance from the expected value of the electric resistance.

The electric resistance of a glow plug is determined by the internal temperature of the glow plug, which can considerably deviate from the surface temperature. Using a method according to the invention, it is nonetheless possible to achieve precise control of the surface temperature on the basis of the electric resistance by using a pressure sensor of the glow plug to measure the combustion chamber pressure and determining the resistance value expected for the target value of the surface temperature as a function of the combustion chamber pressure. The deviations of the surface temperature from the internal temperature of a glow plug are based to a significant extent on a heating or cooling effect of the gases in the combustion chamber. By measuring the combustion chamber pressure, a systematic deviation of the surface temperature of the glow plug from the internal or heating element temperature of the glow plug can be taken into account at least approximately.

FIG. 1 is a schematic illustration for a glow plug of the relationship between the surface temperature in ° C. and the electric resistance, using arbitrary units, at different combustion chamber pressures. Curve A shows, by way of example, the relationship between the surface temperature and electric resistance at a reference pressure, for example 100 bar. Curve B shows, by way of example, the relationship between the surface temperature and electric resistance at an increased combustion chamber pressure, for example combustion chamber pressure increased by 50%, and curve C shows it for a smaller, for example 50% decreased, combustion chamber pressure. It is apparent that the surface temperatures of the glow plug can deviate from each other by more than 100 K for the same resistance and therefore the same internal temperature.

Using a characteristic curve or a family of characteristics, a value of the electric resistance of the glow plug that is expected for the target value of the surface temperature can be determined. In the simplest case, one characteristic curve suffices, which indicates the relationship between the surface temperature and the internal temperature of the glow plug for a reference pressure. Depending on the deviation of the measured combustion chamber pressure from the reference pressure, this characteristic curve can be shifted to adapt the expected value of the resistance to the measured combustion chamber pressure. For example, the expected resistance value can be determined starting from a resistance value for a reference pressure by adding a correction term, which is proportional to the deviation of the measured combustion chamber pressure from the reference pressure, to the resistance value for the reference pressure.

The resistance value that is expected for a specified surface temperature in a defined engine operating state can be determined even more precisely with a glow plug model in which the thermal electric behavior of a glow plug under different boundary conditions is mathematically simulated. Taking the relevant physical laws into consideration, notably heat conduction and heat radiation, the real glow plug behavior can be modeled very precisely using the appropriate material parameters. In addition to the combustion chamber pressure, the injection quantity, the engine speed or the engine load can be used, for example, as input variable for such a glow plug model to calculate the surface temperature.

Regardless of how the expected resistance value is determined in consideration of the measured combustion chamber pressure, it is particularly advantageous to take the crankshaft angle into consideration. For this reason, the crankshaft angle is preferably also captured when measuring the combustion chamber pressure and the electric resistance. The expected resistance value is then determined for a defined crankshaft angle, and a comparison is carried out between the measured resistance and the expected resistance between values that were determined for the same crankshaft angle. The electric resistance and the combustion chamber pressure are preferably measured multiple times during a working cycle of the engine, whereby the curves of the electric resistance and of the combustion chamber pressure can be captured. The curves of the electric resistance and/or of the combustion chamber pressure can be used to determine the crankshaft angle for the individual measurement values.

The deviation of the measured value of the electric resistance from the expected resistance value is used in a method according to the invention as the control difference for calculating the controlled variable, more specifically the effective voltage applied to the glow plug. The effective voltage is generated by pulse width modulation of a vehicle electrical system voltage, for example by applying the vehicle electrical system voltage to the glow plug for short time intervals. The ratio of the duration of the intervals during which the vehicle electrical system voltage is applied to the glow plug to the duration of the intervals during which this is not the case, this meaning that a corresponding switch is open, establishes the effective voltage.

For control purposes, for example, a PID controller, an adaptive controller, or a non-linear controller can be used. In general, linear control approaches, such as PID controllers, state regulators, linear-quadratic regulators, or similar methods are preferred. If linear methods are not sufficient to achieve the control objectives, for example because insufficient stability of the controlled system or inadequate robustness toward fluctuations in the battery voltage becomes apparent, non-linear control methods may be used, for example adaptive controlling or Lyapunov-based control approaches.

The invention claimed is:

1. A method for controlling a glow plug having a surface temperature to a target value of the glow plug surface temperature while an engine is running, with an effective voltage being generated by pulse width modulation of a vehicle electrical system voltage and applied to the glow plug, said method comprising the steps of:

measuring electric resistance of the glow plug and comparing the measured electrical resistance to a resistance value that is expected for the target value of the surface temperature;

varying the effective voltage being applied to the glow plug as a function of a deviation of the measured value of the electrical resistance from the expected value of the electrical resistance; and using a pressure sensor of the glow plug to measure combustion chamber pressure and correcting the resistance value expected for the target value of the surface temperature as a function of the combustion chamber pressure.

2. The method according to claim 1, further further comprising the step of capturing a crankshaft angle during the measurement of the combustion chamber pressure and the electrical resistance, determining the expected resistance value for a defined crankshaft angle, and comparing the measured resistance and the expected resistance for the same crankshaft angle.

3. The method according to claim 2, further comprising the step of determining the crankshaft angle from a curve selected from the group consisting of a curve of the measured resistance and from a curve of the combustion chamber pressure.

4. The method according to claim 1, further comprising the step of determining the value of the electric resistance of the glow plug expected for the target value of the glow plug surface temperature based on one selected from the group consisting of a characteristic curve and a family of characteristics.

5. The method according to claim 1, further comprising the step of determining the expected resistance value starting from a resistance value for a reference pressure by adding a correction term, said correction term being proportional to the deviation of the measured combustion chamber pressure from the reference pressure, to the resistance value for the reference pressure.

6. The method according to claim 1, further comprising the step of determining the resistance value expected for the target value of the glow plug surface temperature as a function of the combustion chamber pressure and as a function of engine rotational speed.

7. The method according to claim 1, further comprising the step of determining the rotational speed by evaluating the curve of the combustion chamber pressure.

8. The method according to claim 1, further comprising the step of determining the resistance value expected for the target value of the surface temperature as a function of combustion chamber pressure and as a function of engine load.

9. A method for controlling a glow plug having a surface temperature to a target value of the glow plug surface temperature while an engine is running, with an effective voltage being generated by pulse width modulation of a vehicle electrical system voltage and applied to the glow plug, said method comprising the steps of:

measuring electric resistance of the glow plug and comparing the measured electrical resistance to a resistance value that is assigned to the target value of the surface temperature;

varying the effective voltage being applied to the glow plug as a function of a deviation of the measured value of the electrical resistance from the assigned value of the electrical resistance; and using a pressure sensor of the glow plug to measure combustion chamber pressure and correcting the resistance value assigned to the target value of the surface temperature as a function of the combustion chamber pressure.

10. A method for controlling a glow plug having a surface temperature to a target value of the glow plug surface temperature while an engine is running, with an effective voltage being generated by pulse width modulation of a vehicle electrical system voltage and applied to the glow plug, said method comprising the steps of:

assigning an expected resistance value to a target value of the surface temperature;

measuring electric resistance of the glow plug and comparing the measured electrical resistance to the expected resistance value;

varying the effective voltage being applied to the glow plug as a function of a deviation of the measured value of the electrical resistance from the assigned value of the electrical resistance; and measuring a combustion chamber pressure and correcting the expected resistance as a function of the combustion chamber pressure.

* * * * *